US007344814B2

(12) United States Patent
Itoh

(10) Patent No.: US 7,344,814 B2
(45) Date of Patent: Mar. 18, 2008

(54) TONER AND IMAGE-FORMING METHOD THEREWITH

(75) Inventor: Muneharu Itoh, Tokyo (JP)

(73) Assignee: Zeon Corporation, Tokyo (JP)

( * ) Notice: Subject to any disclaimer, the term of this patent is extended or adjusted under 35 U.S.C. 154(b) by 0 days.

(21) Appl. No.: 10/721,069

(22) Filed: Nov. 26, 2003

(65) Prior Publication Data

US 2004/0106058 A1 Jun. 3, 2004

(30) Foreign Application Priority Data

Nov. 28, 2002 (JP) ..... 2002-345277

(51) Int. Cl.
*G03G 9/093* (2006.01)

(52) U.S. Cl. ..... 430/108.7; 430/108.1; 430/110.2; 430/110.3; 430/110.4; 430/111.41

(58) Field of Classification Search ..... 430/110.3, 430/111.41, 110.2, 110.4, 108.1, 108.7, 108.6
See application file for complete search history.

(56) References Cited

U.S. PATENT DOCUMENTS

| | | | | |
|---|---|---|---|---|
| 5,837,414 | A * | 11/1998 | Kitani et al. | 430/108.1 |
| 6,074,794 | A * | 6/2000 | Fushimi et al. | 430/109.2 |
| 6,096,468 | A * | 8/2000 | Ohno et al. | 430/108.3 |
| 6,562,535 | B1 * | 5/2003 | Masuo et al. | 430/108.22 |
| 6,653,040 | B2 * | 11/2003 | Ohba et al. | 430/111.32 |
| 6,897,001 | B2 * | 5/2005 | Mizoe et al. | 430/108.6 |
| 2001/0033982 | A1 * | 10/2001 | Ishikawa et al. | 430/110.1 |

FOREIGN PATENT DOCUMENTS

| | | | |
|---|---|---|---|
| JP | 4-177361 | | 6/1992 |
| JP | 5-333757 | | 12/1993 |
| JP | 10-207113 | | 8/1998 |
| JP | 11-072949 | | 3/1999 |
| JP | 11-184166 | | 7/1999 |
| JP | 2000-221726 | * | 8/2000 |
| JP | 2001-242659 | | 9/2001 |
| JP | 2001-318487 | | 11/2001 |
| JP | 2002-296834 | | 10/2002 |
| WO | WO 00/58790 | * | 10/2000 |

OTHER PUBLICATIONS

Japanese Patent Office machine-assisted translation of JP 2000-221726 (pub. Aug. 2000).*

* cited by examiner

*Primary Examiner*—Janis L. Dote
(74) *Attorney, Agent, or Firm*—Kratz, Quintos & Hanson, LLP

(57) ABSTRACT

A toner for an image-forming apparatus and method which apparatus has a cleaning means with a cleaning blade to remove a residual toner remaining on a surface of a photoconductive member after transfer; the toner being a mixture of a colored polymer particle and an external additive. The colored polymer particle has an average circle degree in the range of 0.95-0.995 and a volume average particle diameter in the range of 3-8 μm. The toner has an absolute value of charge amount in the range of 20-70 μC/g in a toner layer formed on a developing roll when the toner is used with the image-forming apparatus.

4 Claims, 2 Drawing Sheets

TONER AND IMAGE-FORMING METHOD THEREWITH

TECHNICAL FIELD

The present invention relates to a toner for an image-forming apparatus, which has a cleaning means with a cleaning blade to remove a residual toner remaining on a surface of a photoconductive member after transfer; the toner comprising a colored polymer particle and an external additive. The present invention relates, in particular, to a toner that has excellent cleaning performance and supplies excellent images, when it is used for such an image-forming apparatus. The present invention also relates to an image-forming method using such a toner.

RELATED ART

An electro photography method is a method for obtaining printed matters, which comprises the steps of: forming an electrostatic invisible image on a photoconductive member; developing the image with an electrostatic invisible image developer toner, comprising a colored polymer particle and an external additive; transferring the toner image to a transferring material such as paper or transparency sheet, and then fixing the toner. There are many conventional methods for developing an image with a toner and for fixing the toner. Methods suitable for each image-forming process are selected and adopted from conventional methods.

Image-forming methods of electro photography comprise the steps of: electrifying a surface of a photoconductive member with a charging member, forming an electrostatic invisible image on the electrified surface of the photoconductive member, forming a toner image by developing the electrostatic invisible image with a toner; transferring the toner image to a transferring material; and fixing the transferred toner image. In these methods, a cleaning means using a cleaning blade is known as a cleaning step of removing a residual toner remaining on the surface of the photoconductive member after transfer. In the cleaning means using the cleaning blade, cleaning performance tends to decline when a toner with a small particle diameter or a spherical toner is used. Further, the residual toner remaining on the surface of the photoconductive member after transfer becomes harder to remove, as a printing speed of the image-forming apparatus becomes higher recently. On the other hand, in image-forming with color toners, a color contamination sometimes occurs if there remains a residual toner on the surface of the photoconductive member after transfer. Therefore, it is desirable that there exists no residual toner remaining on the surface of the photoconductive member after transfer, and a toner with excellent cleaning performance is desired.

In response to these needs, many investigations have been carried out on image-forming apparatuses or methods and toners used therewith. Japanese laid open patent application Hei 4-177361 discloses that cleaning performance of an electrostatic invisible image developing toner can be improved by making an inorganic or resin particle adhered or stuck partly on the surface of a spherical toner particle, where an average particle diameter is 0.01-0.1 times smaller than that of the spherical toner particle. Japanese laid open patent application Hei 5-333757 discloses that, in electro photography having a cleaning step using a rubber blade, cleaning performance can be improved by using a toner with a circle degree in a certain range and a developer with an average adhesion less than a certain value, which adhesion is measured from a rotation rate at a detaching rate of 50% by centrifuging a photoconductive member and a toner.

Japanese laid open patent application Hei 10-207133 discloses that the problem of cleaning defection can be solved by using an electrostatic invisible image developing toner comprising a colored polymer particle and an external additive, which colored polymer particle has a certain volume average particle diameter and a certain shape factor, and which external additive consists of an inorganic particles "A" with a number average particle diameter in the range of 5-70 nm and an inorganic particle "B" with a number average particle diameter in the range of 80-800 nm.

Japanese laid open patent application Hei 4-177361 discloses an electrostatic invisible image developing toner where a fine particle is stuck on the surface of a spherical toner particle, which fine particle has a certain adhesion density. The problem of cleaning defection can be improved to some extent by using such toners disclosed in these arts, but the residual toner remaining on the surface of the photoconductive member cannot be removed sufficiently and more improvement of cleaning performance has been desired.

DISCLOSURE OF THE INVENTION

Therefore, the objective of the present invention is providing a toner that has excellent cleaning performance and supplies excellent images, when it is used with image-forming apparatus which adopts a cleaning means, of removing a residual toner remaining on a surface of a photoconductive member after transfer, with a cleaning blade. The present invention also provides an image-forming method using such a toner.

The inventors of the present invention have performed various research to accomplish the objective and finally found that the objective can be achieved by using a certain toner with an image-forming apparatus which has a cleaning means with a cleaning blade to remove a residual toner remaining on a surface of a photoconductive member after transfer. The toner comprises a colored polymer particle having certain circle degree and a certain volume average particle diameter as a material, and has a certain charge amount in a toner layer formed on a developing roll when it is used with the image-forming apparatus.

The present invention is achieved on the basis of this finding. According to the present invention, there is thus provided a toner for an image-forming apparatus, which has a cleaning means with a cleaning blade to remove a residual toner remaining on a surface of a photoconductive member after transfer; the toner comprising:

a colored polymer particle having an average circle degree in the range of 0.95-0.995 and a volume average particle diameter in the range of 3-8 μm, and an external additive;

wherein the toner has an absolute value of charge amount in the range of 20-70 μC/g in a toner layer formed on a developing roll when the toner is used with the image-forming apparatus. A residual toner can be reduced remarkably, cleaning performance can be improved, and excellent image can be obtained, by using such a toner with an image-forming apparatus which has a cleaning means with a cleaning blade to remove a residual toner remaining on a surface of a photoconductive member after transfer. According to the present invention, there is also provided an image-forming method using such a toner with an image-forming apparatus which has a cleaning means with a cleaning blade to remove a residual toner remaining on a surface of a photoconductive member after transfer.

Figure 1:
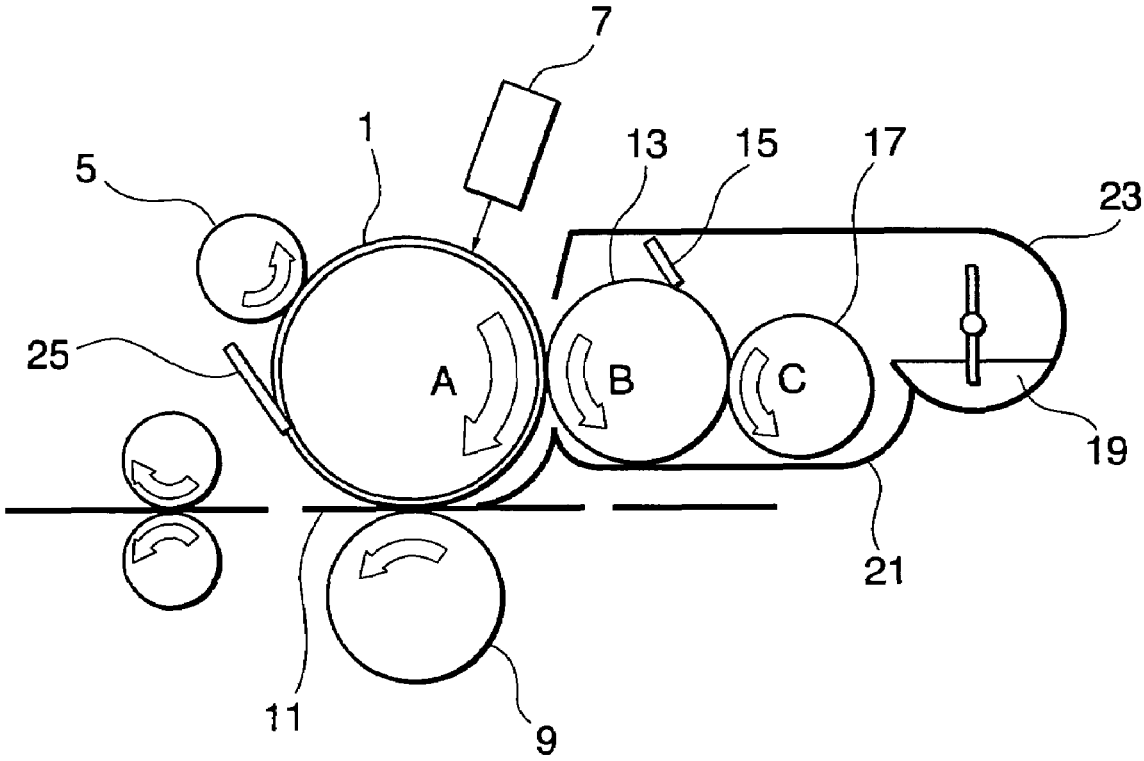
FIGS. 1 and 2 show a sample of an image-forming apparatus related to a toner and an image-forming method of the present invention.

1: Photoconductive member
5: Electrifying roll
7: Laser light irradiation device
9: Transfer roll
11: Transferring material
13: Developing roll
15: Blade for developing roll
17: Supplying roll
19: Toner
21: Developing device
23: Casing
25: Cleaning blade

BEST MODE FOR CARRYING OUT THE INVENTION

The followings are detailed description of a toner and an image-forming method of the present invention. The toner and the image-forming method of the present invention are related to an image-forming apparatus which has a cleaning means with a cleaning blade to remove a residual toner remaining on a surface of a photoconductive member after transfer. A colored polymer particle composing the toner has an average circle degree in the range of 0.95-0.995 and a volume average particle diameter in the range of 3-8 μm. The toner has an absolute value of charge amount in the range of 20-70 μC/g in a toner layer formed on a developing roll when it is used with the image-forming apparatus.

The toner of the present invention is made by adding an external additive to a colored polymer particle comprising a binder resin and a colorant. Here throughout the description and the claims, the word "particle" refers to a group of particles, when appropriate.

Specific examples of binder resins include resins which have been widely used as binder resins for toners, such as polystyrene, styrene-butyl acrylate copolymer, polyester resin, epoxy resin and the like.

Specific examples of colorants include many kinds of pigments and dyes, such as carbon black, titanium black, magnetic particle, oil black and titanium white. Among carbon blacks, such a carbon black that has a primary particle diameter of 20 to 40 nm is preferable because such a carbon black can be dispersed uniformly in the toner and fog in printed image developed using the resultant toner decreases.

Yellow colorants, magenta colorants, cyan colorants and the like are generally used for producing a full color toner. As a yellow colorant, there can be mentioned compounds such as azo pigments and condensed polycyclic pigments. Specific examples of yellow colorants include C.I. Pigment Yellow 3, 12, 13, 14, 15, 17, 62, 65, 73, 74, 83, 90, 93, 97, 120, 138, 155, 180, 181, 185, 186 and the like. As a magenta colorant, there can be mentioned compounds such as azo pigments and condensed polycyclic pigments. Specific examples of magenta colorants include C.I. Pigment Red 31, 48, 57, 58, 60, 63, 64, 68, 81, 83, 87, 88, 89, 90, 112, 114, 122, 123, 144, 146, 149, 150, 163, 170, 184, 185, 187, 202, 206, 207, 209, 251 and the like and C.I. Pigment Violet 19 and the like. As a cyan colorant, there can be mentioned phthalocyanine-copper compounds or their derivatives, anthraquinone compounds and the like. Specific examples of cyan colorants include C.I. Pigment Blue 2, 3, 6, 15, 15:1, 15:2, 15:3, 15:4, 16, 17, 60 and the like. These colorants may be used preferably in the proportion of 1 to 10 parts by weight per 100 parts by weight of the binder resin used.

In the present invention, a charge control agent may be preferably used as one of additives for the colored polymer particle to control the charge amount of the resultant toner. Among charge control agents, charge control resins are preferable, because the charge control resins are well compatible with the binder resins used, they are colorless, and a toner having a stable charging property can be obtained even at high-speed color continuous printing. Specific examples of the charge control resins include: copolymers having quaternary ammonium group (or salt group thereof) such as those synthesized according to the disclosure in Japanese laid open patent application Shou 63-60458, Japanese laid open patent application Hei 3-175456, Japanese laid open patent application Hei 3-243954 and Japanese laid open patent application Hei 11-15192; copolymers having sulfonic acid group (or salt group thereof) such as those synthesized according to the disclosure in Japanese laid open patent application Hei 1-217464 and Japanese laid open patent application Hei 3-15858. The portion of constitutional repeating units having quaternary ammonium group (or salt group thereof) or sulfonic acid group (or salt group thereof) in these copolymers should be preferably in the range of 0.5-15 weight %, and more preferably in the range of 1-10 weight %. If the portion is in this range, the charge amount of the resultant toner is easy to control and fog in printed image developed therewith decreases.

The charge control resin should have a weight average molecular weight preferably in the range of 2,000-50,000, more preferably in the range of 4,000-40,000, and most preferably in the range of 6,000-35,000. If the molecular weight is below 2,000, a mixture for manufacturing a toner tends to have a too low viscosity during mixing and a pigment tends to disperse uniformly. The charge control resin should have a glass transition temperature preferably in the range of 40-80° C., more preferably in the range of 45-75° C., and most preferably in the range of 45-70° C. If the glass transition temperature is below 40° C., the stability of the resultant toner tends to decline. If the glass transition temperature is beyond 80° C., fixability of the resultant toner tends to decline.

In the present invention, a negative charge control resin and a positive charge control resin can be used at a same time. The preferable proportion of the charge control resins changes according to whether the resultant toner be a negative charging toner or a positive charging toner. To obtain a negative charging toner, it is necessary to control, the molar equivalent of functional groups (such as sulfonic acid group) causing negative charging character, to be larger than that of functional groups (such as quaternary ammonium group) causing positive charging character, in the charge control resins. To obtain a positive charging toner, it is necessary to reverse the above control. The charge control agent may be used generally in the proportion of 0.01-30 parts by weight, and preferably in the proportion of 0.3-30 parts by weight, per 100 parts of weight of the binder resin used.

In the present invention, a parting agent is preferably used as one of additives in the colored polymer particle. As the parting agent, there can be mentioned: polyolefin waxes such as low molecular weight polyethylene, low molecular weight polypropylene and low molecular weight polybutylene; natural plant waxes such as candelilla, carnauba wax, rice, wood wax and jojoba oil; petroleum waxes such as paraffin, microcrystalline wax and petrolactam, and denaturations thereof; synthesized waxes such as Fischer Tropsch wax and the like; multifunctional ester compounds such as pentaerythritol tetramyristate, pentaerythritol tetrapalmitate and dipentaerythritol hexamyristate; and the like. These parting agents may be used alone or in a combination thereof.

Among these as listed here, the synthesized waxes and the multifunctional ester compounds are preferable. And the multifunctional ester compounds having a certain peak endothermic temperature are more preferable, because a toner with an excellent balance of fixing—peeling property during fixing can be obtained; the peak endothermic temperature should be preferably in the range of 30-150° C., more preferably in the range of 40-100° C., and most preferably in the range of 50-80° C., where the peak endothermic temperature is measured with a DSC curve using a differential scanning calorimetry meter at rising temperature, according to ASTM D 3418-82. Among these parting agents, the parting agent which has a molecular weight not smaller than 1,000, is soluble in the proportion more than 5 parts by weight to 100 parts by weight of styrene at 25° C., and has an acid value not larger than 10 mgKOH/g, are further preferable, because it has a remarkable contribution for lowering the fixing temperature. The parting agent is used generally in the proportion of 0.5 to 50 parts by weight, and preferably in the proportion of 1 to 20 parts by weight, per 100 parts by weight of the binder resin used.

A colored polymer particle can be so called core-shell structured (or "capsule type" particle), which is produced by combining two different polymers, where one polymer is used for an inner layer (core layer) and the other polymer is used for an outer layer (shell layer). In the core-shell structure colored polymer particle, it is preferable to cover the inner layer (core layer) made of a material having rather lower glass transition temperature with a material having higher glass transition temperature than that of the inner layer, because an excellent balance of lowering of fixing temperature and avoiding cohesion during storage can be achieved. In general, the core layer of the core-shell structure colored polymer particle comprises a binder resin, a colorant, a charge control resin and a parting agent, and the shell layer consists of a binder resin.

In case of a core-shell structure colored polymer particle, the volume average particle diameter of the core particle is generally 3-8 μm, and preferably 4-8 μm. The particle diameter distribution (described as Dv/Dp; Dv is volume average particle diameter; Dp is number average particle diameter) of the core particle is preferably in the range of 1.0-1.3, and more preferably in the range of 1.0-1.2. The weight ratio of the core layer/the shell layer in the core-shell structure colored polymer particle is not limited, and is preferably in the range of 80/20-99.9/0.1. If the ratio is in the preferable range, the toner has not only excellent shelf stability but also improved fixability at lower temperature.

The thickness of the shell layer is generally in the range of 0.001-1.0 μm, preferably in the range of 0.003-0.5 μm, and more preferably in the range of 0.005-0.2 μm. If the shell layer is too thick, the resultant toner has lowered fixability; if the shell layer is too thin, the resultant toner tends to have deteriorated shelf stability. It is not necessary to cover all the surface of the core particle of the core-shell structure colored polymer particle with the shell layer; and it is sufficient that a part of the surface of the core particle is covered with the shell layer. The particle diameters of the core particles and thickness of the shell layer can be obtained by measuring directly the particle diameters or the thickness of the shell layer of the particles selected at random, with using photographs thereof, if they are observable with an electron microscope. The particle diameters of the core particles and the thickness of the shell layer can be obtained by calculation by using the values of the particle diameters of the core particles and the amount of the polymerizable monomer used for polymerization of shell layer, if core and shell are difficult to observe with an electron microscope.

The colored polymer particle which comprise the toner of the present invention has an average circle degree in the range of 0.95-0.995, preferably in the range of 0.95-0.99, and further preferably in the range of 0.96-0.99. If the average circle degree is below 0.95, the resultant toner is poor in fine line reproduction at a L/L condition (temperature: 10° C., relative humidity: 20% RH), a N/N condition (temperature: 23° C., relative humidity: 50% RH), and a H/H condition (temperature: 35° C., relative humidity: 80% RH). The average circle degree can be controlled into the above-mentioned range rather easily with a phase inversion emulsion method, a dissolution suspension method, a polymerization method, and the like.

In the present invention, the circle degree of a particle is defined as circuit length of the circle which has the same area with the projection of the particle, divided by perimeter length of the projection of the particles. The average circle degree is adopted to represent shapes of the particle quantitatively and simply, and it is an index which shows a degree of the roughness of the particles. If the toner particles are perfectly spherical, the average circle degree equals to 1. The more complicated the surface of the colored polymer particles are, the smaller the average circle degree becomes. The circle degree ($C_i$) of each particle is obtained with measured lengths and the equation below for n particles, which particles have particle diameters not smaller than 1μ/m. Then the average circle degree (Ca) is calculated using formula 1.

$C_i$=circuit length of the circle having the same area with the projection of each particle/perimeter length of the projection of each particle $$Ca = \sum_{i=1}^{n} (C_i \times f_i) \Big/ \sum_{i=1}^{n} f_i \qquad \text{Formula 1}$$

In formula 1, $f_i$ denotes frequency of particles having circle degree $C_i$. The circle degree and the average circle degree may be measured with flow type particle projection image analyzers, such as FPIA-1000 or FPIA-2000, products of Sysmex Corporation.

The toner of the present invention has a volume average particle diameter Dv in the range of 3-8 μm, and preferably in the range of 4-8 μm. If the Dv is below 3 μm, the toner tends to have poor fluidity, to cause fog in printed image or remaining image on the photoconductive member, and to have lowered cleaning performance. If the Dv is above 8 μm, the toner tends to be poor in fine line reproduction. The colored polymer particle, which the toner of the present invention made of, preferably has a particle diameter distribution where the portion of particles having diameters not larger than 4 μm is preferably in the portion of 3-70 number %, more preferably in the portion of 3-60 number %, and most preferably in the portion of 3-50 number %. If the portion is beyond the above-mentioned preferable portion, the toner tends to have a lowered cleaning performance or resolution.

The toner of the present invention is produced by adding an external additive to a colored polymer particle comprising a binder resin and a colorant and adhering the external additive to the surface of the colored polymer particle. It is possible to control charging properties, fluidity, and shelf life, of the colored polymer particle, by thus adding an external additive. The toner of the present invention is controlled to have an absolute value of charge amount in the range of 20-70 μC/g, and preferably in the range of 20-60

μC/g, in a toner layer formed on a developing roll when the toner is used with an image-forming apparatus which has a cleaning means with a cleaning blade to remove a residual toner remaining on a surface of a photoconductive member after transfer. It is preferable to use an external additive as described in the following. As to image-forming apparatus, explanation thereof is to be further disclosed. If the absolute value of charge amount of the toner is below 20 μC/g, fog tends to occur in the printed image; on the other hand, if it is beyond 20 μC/g, the toner tends to have a poor cleaning performance because the toner binds too tightly to the photoconductive member.

As to an external additive used for the toner of the present invention, an inorganic particle (A) with a volume average primary particle diameter in the range of 0.1-3.0 μm are preferable. The volume average particle diameter is preferably in the range of 0.1-1.0 μm, and more preferably in the range of 0.1-0.5 μm. By using such an inorganic particle as an external additive, a residual toner can be removed easily by a cleaning blade and cleaning performance can be improved, because interspace takes place between the photoconductive member and the toner. Therefore, if the volume average particle diameter of the inorganic particle (A) is below 0.1 μm, the interspace between the photoconductive member and the toner is not sufficient and the toner tends to have a poor cleaning performance. On the other hand, if the volume average particle diameter of the inorganic particle (A) is beyond 3 μm, the adhesion between the colored polymer particle and the inorganic particle is not sufficient, and the inorganic particle (A) tend to detach easily from the colored polymer particle. As a result, the image-forming apparatus tends to have insufficient cleaning performance. Further, the number of particles of an external additive adhered to a colored polymer particle decreases, the interspace between the photoconductive member and the colored polymer particle becomes insufficient, so the image-forming apparatus tends to have insufficient cleaning performance.

The particle diameter distribution (described as Dv/Dp; Dv is volume average particle diameter; Dp is number average particle diameter) of the inorganic particle (A) is preferably in the range of 1-5, more preferably in the range of 1-4, and most preferably in the range of 1-3. If the particle diameter distribution Dv/Dp is beyond 5, the toner tends to have insufficient cleaning performance even at the aimed charge amount, and the toner tends to cause fog or other defects in a printed image, because the distribution of the charge amounts of the toner becomes wide.

The amount of the inorganic particle (A) is generally in the proportion of 0.1-5 parts by weight, preferably in the proportion of 0.2-3 parts by weight, more preferably in the proportion of 0.3-2 parts by weight, per 100 parts by weight of the colored polymer particle. If the proportion is below 0.1 part, the image-forming apparatus tends to have insufficient cleaning performance because interspace between the photoconductive member and the colored polymer particles becomes insufficient. If the proportion is beyond 5 parts, the external additive tends to pollute some members of the image-forming apparatus and to harm the photoconductive members and, as a result, the image-forming apparatus tends to have insufficient cleaning performance.

Specific examples of such an inorganic particle (A) include: inorganic carbides such as silicone carbide, boron carbide and titanium carbide; inorganic nitrides such as boron nitride, titanium nitride and zirconium nitride; inorganic oxides such as titanium oxide, zinc oxide, copper oxide and silica; inorganic salts such as calcium phosphate, calcium carbonate, magnesium carbonate and calcium sulfate; and the like. Among these, inorganic salts are preferable and, especially, calcium phosphate and calcium carbonate are more preferable.

It is preferable to use a small-sized fine silica particle (B) having a volume average primary particle diameter generally in the range of 5-18 nm, and preferably in the range of 7-16 nm, in addition to the inorganic particle (A). In further addition to an inorganic particle (A) and/or a small-sized fine silica particle (B), it is preferable to use a large-sized fine silica particle (C) having a volume average primary particle diameter generally in the range of 20-60 nm, and preferably in the range of 25-50 nm. If the volume average particle diameter of the small-sized fine silica particle (B) is below 5 nm, the photoconductive member tends to cause filming. On the other hand, the volume average particle diameter of the large-sized fine silica particle (C) is beyond 60 nm, the toner tends to have poor fluidity and causes bluring.

The external additives; an inorganic particle (A), a small-sized fine silica particle (B) and a large-sized fine silica particle (C); have preferably been subjected to a hydrophobicitizing treatment. A hydrophobicitized inorganic particle or fine silica particle is available on the market, or obtained by hydrophobicitizing an untreated inorganic particle or silica fine particle with a hydrophobicitizing agent such as silane couplers, silicone oils, fatty acids metallic soaps, and the like. As a hydrophobicitizing treatment there can be mentioned: dropping or spraying the hydrophobicitizing agent onto an inorganic particle (A), a small-sized fine silica particle (B) or a large-sized fine silica particle (C), during stirring the mixture at high speed; making solution of the hydrophobicitizing agent and an organic solvent, adding and an inorganic particle (A), a small-sized fine silica particle (B) or a large-sized fine silica particle (C) into the solution to the during stirring, and then heating. In case of the former, the hydrophobicitizing agent can be used after dilution with an organic solvent and the like. Hydrophobicity degree of the particle is preferably in the range of 10-90%, and more preferably in the range of 15-80%, measured according to methanol method. If the degree is below 10%, the particle tend to be absorbent; if beyond 90%, the particle tend to have insufficient grinding property. The proportion of the small-sized fine silica particle (B) and the large-sized fine silica particle (C) is preferably in the range of 0.1-3 parts by weight, and more preferably in the range of 0.2-2 parts by weight, respectively, per 100 parts by weight of the colored polymer particle.

The toner of the present invention comprises an external additive, wherein the average number of particles of the external additive, having a particle diameter in the range of 0.1-3.0 μm, on the surface of the colored polymer particle, is preferably in the range of 3-500 particles, more preferably in the range of 10-350 particles, per single colored polymer particle. If the average number is below 3 particles, interspace between the photoconductive member and the colored polymer particle becomes insufficient, and the image-forming apparatus tends to have insufficient cleaning performance. If the average density is beyond 500 particles, the external additive tends to pollute some members of the image-forming apparatus and to harm the photoconductive members and, as a result, the image-forming apparatus tends to have insufficient cleaning performance.

The toner of the present invention is for an image-forming apparatus which has a cleaning means with a cleaning blade to remove a residual toner remaining on a surface of a photoconductive member after transfer. The present invention relates to such an image-forming apparatus and an image-forming methods using such a toner. The following is an explanation of the image-forming apparatus to which the present invention relates, with reference to figures.

FIG. 1 shows a schematic example of an image-forming apparatus to which the present invention relates. The image-forming apparatus in FIG. 1 comprises a photoconductive drum 1 as a photoconductive member. The photoconductive drum 1 is set as rotatable in the direction of arrow A. The photoconductive drum 1 is made by laying a photoconductive layer on a conductive substrate drum, which photoconductive layer comprises, for instance, an organic photoconductive compound, a selenium photoconductive compound, an amorphous silicon photoconductive compound, or the like. Among these, the photoconductive layer preferably comprises an organic photoconductive compound. The photoconductive layer is bound to the conductive substrate drum. Specific examples of the binder resin, used for binding the photoconductive layer to the conductive substrate drum, include polyester resins, acrylic resins, polycarbonate resins, phenol resins, epoxy resins, and the like. Among these, the polycarbonate resins are preferable. There placed a electrifying roll 5 as a electrifying member, a laser light irradiation device 7 as a light irradiation device, a developing device 21, a transfer roll 9, and a cleaning blade 25, around the photoconductive drum 1 along its circuit.

An image-forming method using the image-forming apparatus as in FIG. 1 comprises: an electrifying step, a light irradiation step, a developing step, a transfer step, and a cleaning step, as described below. The electrifying step is a step where the surface of the photoconductive drum 1 is charged positively or negatively, uniformly, with an electrifying member. Specific manners how to electrify the surface with electrifying members include: the manner using electrifying roll 3 as described in FIG. 1; a contact electrification manner where electrifying is achieved with a fur brush, a magnetic brush, or a blade; and a non-contact electrification manner where electrifying is achieved by corona discharge. The electrification manner in FIG. 1 can be substituted by the contact electrification manner or the non-contact electrification manner.

The light irradiation step is a step of forming an electrostatic invisible image on the photoconductive drum 1 which has been electrified uniformly, by irradiating light corresponding to image signal with a laser light irradiation device 7. Such a laser light irradiation device comprises, for instance, a laser light source and optical lenses. Besides the laser light irradiation device as in FIG. 1, an LED light irradiation device is also available.

The developing step is a step of attaching a toner to the electrostatic invisible image, formed on the photoconductive drum 1 during the light irradiation step, with the developing device 21. A bias voltage is applied between the developing roll 13 and the photoconductive drum 1 so that the toner attaches only to the photo irradiated area in reversal development and only to non-irradiated area in regular development.

The developing device 21 that is furnished by the image-forming apparatus in FIG. 1, is for one component contact developing method, where there are a developing roll 13 and a supplying roll 17 in the casing 23 which contains the toner 19. The developing roll 13 is placed so that a part of it touches the photoconductive drum 1, and is rotatable in the direction B that opposes to the photoconductive drum 1. The supply roll 17 is placed so that: it touches the developing roll 13; it is rotatable in the direction C that is same direction with that of the developing roll 13; and it supplies the toner 19 to the outer circuit of the developing roll 17. As a developing method, one component non-contact developing method, two component contact developing method, and two component non-contact developing method, are also available.

There is placed a blade for developing roll 15 to control the thickness of the toner layer, between the point of contact with the supplying roll 17 and the point of contact with the photoconductive drum 1, on the circuit of the developing roll 13. The blade for developing roll 15 is made of, for example, conductive rubber elastomer or metal.

The transfer step is a step of transferring the toner image, formed with the developing device 21 on the photoconductive drum 1, onto a transferring material such as paper. In general, the transfer step is achieved with a transfer roll 9 as shown in FIG. 1. Besides the transfer roll, the transfer step is achieved with a belt or by corona transfer. The cleaning step is a step of removing the residual toner remaining on the surface of the photoconductive member after transfer. In the image-forming apparatus in FIG. 1, a cleaning blade 25 is used to remove the residual toner.

In the image-forming apparatus as shown in FIG. 1, the surface of the photoconductive drum 1 is electrified negatively and uniformly with the electrifying roll 5, then an electrostatic invisible image is formed with the laser light irradiation device 7, and a toner image is formed by developing step. Then the toner image on the photoconductive drum 1 is transferred onto a transferring material such as paper with a transfer roll 9. The residual toner remaining on the surface of the photoconductive member after transfer is removed with the cleaning blade 25. Then the next image-forming cycle starts. The toner of the present invention has an absolute value of charge amount, in the range of 20-70 μC/g, preferably in the range of 20-60 μC/g, in the toner layer formed on the developing roll when the toner is used with the image-forming apparatus. The charge amount of the toner layer formed on the developing roll, may be measured as a charge amount per unit weight, from the total charge amount and total weight of the toner of the toner layer, by aspirating and collecting the toner with an aspirating type charge amount analyzer.

Figure 2:
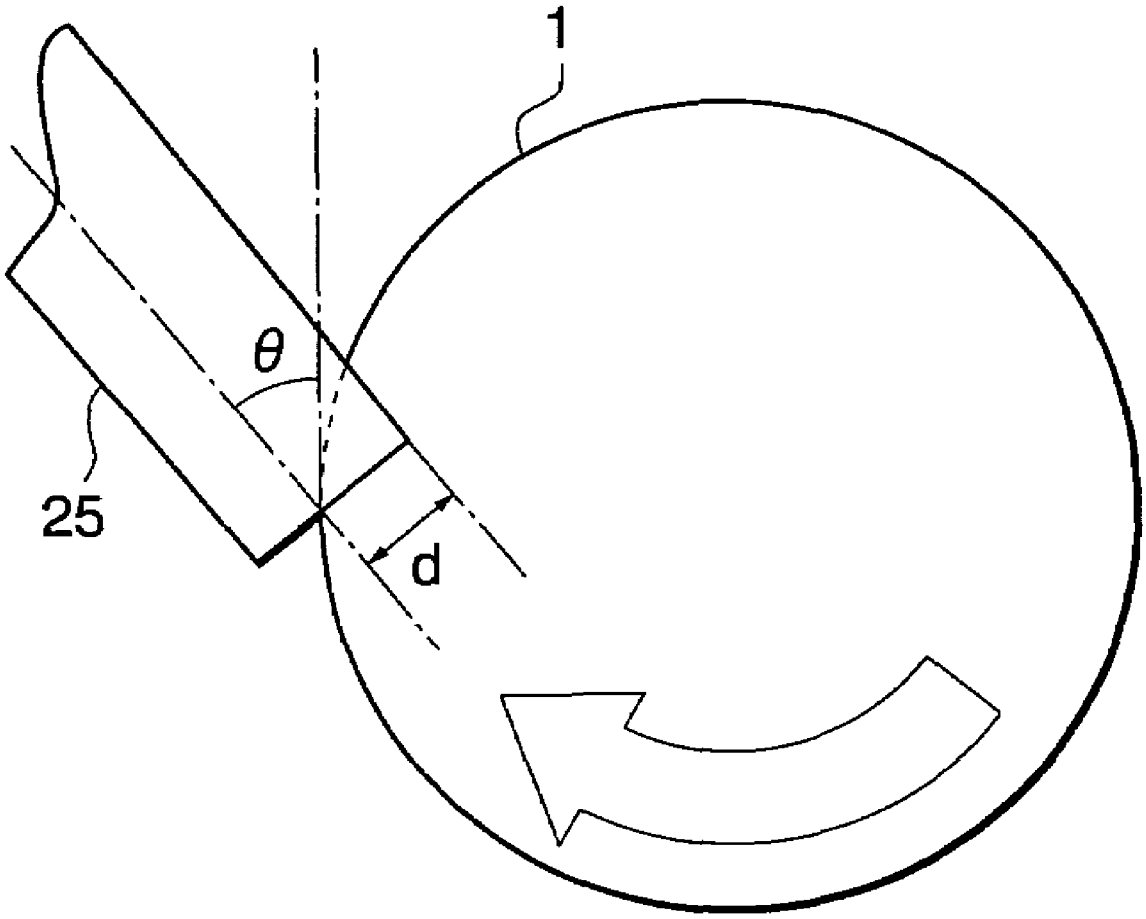

FIG. 2 shows an enlarged schematic view of the photoconductive drum and the cleaning blade in the image-forming apparatus. The cleaning blade, used in the image-forming apparatus, shown in FIG. 1, touches the surface of the photoconductive drum from the opposite direction (in the counter direction) of the rotating direction of the photoconductive drum, with a certain intrusion depth d, with a certain set angle θ, as shown in FIG. 2. Here; the intrusion depth d denotes intruding depth of the blade measured along the perpendicular direction to the axis of the blade, assuming the tip of the blade intrudes into the photoconductive member without any transformation; and the set angle θ denotes the angle between the surface of the photoconductive member and the axis of the cleaning blade at the cross point of the photoconductive member and the cleaning blade. The intrusion depth d is in the range of 1.3-2.5 mm, preferably in the range of 1.4-2.3 mm, and more preferably in the range of 1.5-2.0 mm. If the depth d is beyond the range, the cleaning blade tends to twist; if below the range, cleaning tends to be defective. The set angle θ is preferably in the range of 20-30°, more preferably in the range of 22-28°, and most preferably in the range of 24-26°. If the angle is beyond the range, the cleaning blade tends to twist; if below the range, cleaning tends to be defective. The thickness of the tip of the cleaning blade is in the range of 1-2.5 mm, preferably in the range of 1.2-2.3 mm, and more preferably in the range of 1.4-2.1 mm. If the thickness is beyond the range, the cleaning blade tends to scrape the photoconductive member; if below the range, the cleaning blade tends to twist. The hardness (JIS-A) of the cleaning blade, measured according to JIS K 6301: 1995, is in the range of 60-90, preferably in the of 65-80, and more preferably in the range of 68-75. If the hardness is beyond the range, the cleaning blade tends to scrape the photoconductive member; if below the range, the cleaning blade tends to twist. The cleaning blade 25 is made of rubber elastomer, such as polyurethane, acrylonitrile butadiene copolymer, and the like. The rebound resilience of the cleaning blade is preferably in the range of 30-70%, and more preferably in the range of 40-70%. If the value is below 70%, the image-forming apparatus tends to have poor cleaning performance. The rebound resilience of the cleaning blade may be measured, for instance, according to Lupke method (JIS K 6255:1996). The rebound resilience can be controlled, for instance, by selecting vulcanization condition, such as a proportion of vulcanization agent in the rubber elastomer.

Though the image-forming apparatus shown in FIG. 1 is for monochrome image, the present invention can be applied to color image-forming apparatuses, such as color image-forming copiers or printers. Color image-forming apparatuses adopt multiple developing method or multiple transfer method. In the multiple developing method, a multi-colored toner image is developed and formed on the photoconductive member, and then the toner image is transferred to a transferring material at a time. In the multiple transfer method, each mono-colored toner image is developed and formed on the photoconductive member, the toner image of each color is transferred to a transferring material, then the developing and the transfers take place repeatedly for necessary times, which number of times equals to number of color toners used. As to the multiple transfer method, transfer drum method, intermediate material method and tandem method are available. In the transfer drum method, a transferring material is coiled around a transfer drum, and the toner image is transferred for every color. In the intermediate material method, the toner image is primarily transferred to a single intermediate transferring material for every color, the color toner image is formed on the intermediate transferring material, and then the color toner image is secondarily transferred to a transferring material at a time. In the tandem method, members other than a photoconductive member are placed in a tandem, a transferring material is suctioned and conveyed with a transferring and conveying belt, and each color toner image is transferred one by one. Among these methods, the tandem method is preferable because image-forming speed can be high.

The following is a description about the process for producing a colored polymer particle by polymerization method. The colored polymer particle, which comprise the toner of the present invention, can be produced by: dissolving or dispersing a colorant, charge control agent and other additives into a polymerizable monomer, which is a raw material of the binder resin; polymerizing the polymerizable monomer in a aqueous dispersion medium including a dispersion aid after adding a polymerization initiator; associating the resulting colored polymer particles each other, if necessary; filtering; rinsing; dehydrating; and then drying.

In the present invention, a charge control resin composition, which is produced by mixing a colorant and a charge control resin in advance, is also available. In this case, the proportion of the colorant is generally in the range of 10-200 parts by weight, and preferably in the range of 20-150 parts by weight, per 100 parts by weight of the charge control resin.

It is preferable to use an organic solvent during production of a charge control resin composition. With an organic solvent, charge control resin becomes soft and easier to mix with the colorant. The proportion of the organic solvents is in the range of 0-100 parts by weight, preferably in the range of 5-80 parts by weight, more preferably in the range of 10-60 parts by weight, per 100 parts by weight of the charge control resin. If the proportion is in the range, the balance of dispersing degree of the colorant and processing properties is excellent. The organic solvent may be added, at a time, or dividedly for several times with observing dispersing degree. Mixing can be achieved with a roll machine, a kneader, a single screw extruder, a double screw extruder, a Bunbury mixer, or a Buss co-kneader. In case that an organic solvent is used, a mixer, with a structure sealing the organic solvent off, is preferable to avoid the problem of bad smell and toxicity. The mixer preferably furnishes a torque meter, because dispersion degree can be monitored and controlled by a value of the torque.

As a polymerizable monomer, a raw material of the binder resin, there can be mentioned, for instance, a monovinyl monomer, a cross-linkable monomer and a macromonomer. These polymerizable monomers become the binder resin component after polymerization. Specific examples of the monovinyl monomers include: aromatic vinyl monomers such as styrene, vinyl toluene and α-methyl styrene; acrylic acid and its derivatives such as methyl acrylate, ethyl acrylate, propyl acrylate, butyl acrylate, 2-etylhexyl acrylate, cyclohexyl acrylate, isobonyl acrylate, dimethylaminoethyl acrylate and acrylamide; methacrylic acid and its derivatives such as methyl methacrylate, ethyl methacrylate, propyl methacrylate, butyl methacrylate, 2-etylhexyl methacrylate, cyclohexyl methacrylate, isobonyl methacrylate, dimethylaminoethyl methacrylate and methacrylamide; and mono olefin monomers such as ethylene, propylene and butylene; and the like. The monovinyl monomers may be used alone or in a combination thereof. Among the monovinyl monomers as mentioned above, it is preferable to use aromatic vinyl monomers alone, or to use aromatic vinyl monomers in a combination with acrylic acid derivatives or methacrylic acid derivatives.

It is desirable to use a cross-linkable monomer together with the monovinyl monomer to improve a hot offset property. The cross-linkable monomer is a monomer which has plural vinyl groups. Specific examples of the cross-linkable monomers include divinylbenzene, divinylnaphthalene, ethylene glycol dimethacrylate, pentaerythritol triallyl ether, trimethyrolpropane triacrylate; and the like. The cross-linkagable monomers may be used alone or in a combination thereof. They may be used generally in the proportion not larger than 10 parts by weight, preferably in the proportion of 0.1-2 parts by weight, per 100 parts by weight of the monovinyl monomer.

Additional use of a macromonomer together with the monovinyl monomer is preferable to balance the shelf stability and the fixability at a low temperature of the resultant toner. The macromonomer is an oligomer or polymer having a polymerizable functional group involving carbon-carbon-double bond at its molecular chain terminal and a number average molecular weight generally in the range of about 1,000-30,000.

The macromonomer is preferably such that glass transition temperature, of a resultant polymer obtained by polymerizing thereof alone, is higher than that of a resultant polymer obtained by polymerizing the monovinyl monomer used alone. The macromonomer may be used generally in the proportion of 0.01-10 parts by weight, preferably in the proportion of 0.03-5 parts by weight, and more preferably in the proportion of 0.05-1 parts by weight, per 100 parts by weight of the monovinyl monomer used.

As a dispersion stabilizer, conventional surfactants or organic or inorganic dispersion stabilizers are available. Among these dispersion stabilizers, the inorganic dispersion stabilizers are preferable because they are easily removed by a post treatment. Specific examples of the inorganic dispersion stabilizers include: inorganic salts such as barium sulfate, calcium carbonate and calcium phosphate; inorganic oxides such as silica, aluminium oxide and titanium oxide; inorganic hydroxides such as aluminium hydroxide, magnesium hydroxide and iron (III) hydroxide; and the like. Among these, dispersion stabilizers, including hardly water-soluble colloid of an inorganic hydroxides, are especially preferable, because the resultant colored polymer particle has a narrow particle diameter distribution, they remain little in the colored polymer particle after rinsing, and clear image can be reproduced by using the resultant toner. The dispersion stabilizer is used generally in the proportion of 0.1-20 parts by weight per 100 parts by weight of the polymerizable monomer used. If the proportion is in the above-mentioned range, the polymerization reaction occurs sufficiently stably, generation of polymer aggregates decreases, and a toner with desired particle diameter can be obtained.

As a polymerization initiator, there can be mentioned: persulfates such as potassium persulfate and ammonium persulfate; azo compounds such as 4,4'-azobis(4-cyanovaleric acid), 2,2'-azobis{2-methyl-N-(2-hydroxyethyl)propionamide}, 2,2'-azobis(2-amidinopropane)dihydrochloride, 2,2'-azobis(2,4-dimethylvaleronitrile), dimethyl-2,2'-azobis (2-methylpropionate) and 2,2'-azobisisobutyronitrile; peroxides such as di-t-butyl peroxide, dicumyl peroxide, lauroyl peroxide, benzoyl peroxide, t-butyl peroxy-2-ethylhexanoate, t-hexylperoxy-2-ethylhexanoate, t-butyl peroxypivalate, diisopropyl peroxy dicarbonate, di-t-butyl peroxyisophthalate, 1,1,3,3-tetramethylbutyl peroxy-2-ethylhexanoate and t-butyl peroxy isobutylate; and the like. Redox initiators, combining these polymerization initiators with a reducing agent, may also be used.

Among these polymerization initiators, oil-soluble polymerization initiators which are soluble to the polymerizable monomer are preferable, which oil-soluble polymerization initiators may be used in a combination with water-soluble polymerization initiators. The polymerization initiator is used in the proportion of 0.1-20 parts by weight, preferably in the proportion of 0.3-15 parts by weight, more preferably in the proportion of 0.5-10 parts by weight, per 100 parts by weight of the polymerizable monomer used. The polymerization initiator can be contained in a polymerizable monomer composition in advance. In case of suspension polymerization, it also can be added directly to a suspension after generating droplets of the polymerizable monomer composition. In case of emulsion polymerization, it also can be added directly to an emulsion after generating the emulsion.

A molecular weight modifier is preferably used as one of additives during polymerization reaction. As a molecular weight modifier, there can be mentioned: mercaptans such as t-dodecylmercaptan, n-dodecylmercaptan, n-octylmercaptan and 2,2,4,6,6-pentamethyl heptane-4-thiol; thiuram disulfides such as tetramethyl thiuram disulfide and tetraethyl thiuram disulfide; and the like. The molecular weight modifier may be added before or during polymerization reaction. The molecular weight modifier is used generally in the proportion of 0.01-10 parts by weight, and preferably in the proportion of 0.1-5 parts by weight, per 100 parts by weight of the polymerizable monomer used.

There is no limitation for producing process of the above-mentioned preferable core-shell structure colored polymer particle, and conventional processes are available. For instance, spray dry method, interface reaction method, in situ polymerization method and phase separation method are available. More specifically, a core-shell structure colored polymer particle is produced by: using a colored polymer particle, produced by pulverizing method, polymerization method, association method or phase inversion emulsion method, as core particles; then covering it with a shell layer. Among these methods, in situ polymerization method and phase separation method are preferable because throughput is high.

The followings are descriptions about a producing process of a core-shell structure colored polymer particle adopting in situ polymerization method. A core-shell structure colored polymer particle is produced by: adding a polymerizable monomer to generate a shell layer (referred as "polymerizable monomer for shell" hereinafter) and a polymerization initiator into a dispersion medium where a core particle disperse; then polymerizing the polymerizable monomer for shell. Specific examples of methods for generating shell layer include: polymerizing the polymerizable monomer for shell continuously by adding the polymerizable monomer for shell into the polymerization system where a polymerization reaction for generation of the core particle has taken place; polymerizing the polymerizable monomer for shell, step by step, after preparing a core particle in another separated polymerization system and mixing the core particle and the polymerizable monomer for shell; and the like. The polymerizable monomer for shell can be added to the polymerization system at a time, or continuously or intermittently using a pump such as a plunger pump.

Specific examples of the polymerizable monomers for shell include styrene, acrylonitrile and methyl methacrylate, which generate polymers with glass transition temperature higher than 80° C. if they are polymerized alone. These monomers can be used alone or in a combination thereof.

It is desirable to add a water-soluble polymerization initiator to the polymerization system, at the time the polymerization monomer for shell is provided, in order to generate shell efficiently. This is because the water-soluble polymerization initiator arrives near to the outer surface of the core particle where the polymerization monomer for shell exists, and the polymer layer (shell) is easily generated on the surface of the core particle, if the water-soluble polymerization initiator is added.

As the water-soluble polymerization initiator, there can be mentioned: persulfates such as potassium persulfate and ammonium persulfate; azo compounds such as 2,2'-azobis{2-methyl-N-(2-hydroxyethyl)propionamide} and 2,2'-azobis{2-methyl-N-{1,1-bis(hydroxymethyl)ethyl} propionamide}; and the like. The water-soluble polymerization initiator may be used generally in the proportion of 0.1-50 parts by weight, and preferably in the proportion of 1-30 parts by weight, per 100 parts by weight of the polymerizable monomer for shell.

It is desirable to add acid or alkali, to the dispersion of the colored polymer particle obtained from polymerization reaction, to dissolve the dispersion stabilizer by water, and to remove it from the dispersion. It is desirable to control pH of the dispersion less or equal to 6.5 by adding acid, if a colloid of hardly water-soluble inorganic hydroxide has been used as the dispersion stabilizer. Specific examples of such acids include: inorganic acids such as sulfuric acid, hydrochloric acid and nitric acid; and organic acids such as formic acid and acetic acid. Among these acids, sulfuric acid is especially preferable, because it has a high removing efficiency and a light load to processing facilities. There is no limitation for filtering and dehydrating the colored polymer particle from the aqueous dispersion. For example, centrifugal filtration, vacuum filtration, pressure filtration, and the like are available. Centrifugal filtration is preferable among these.

The toner of the present invention may be obtained by mixing a colored polymer particle, a external additive, and another optional particle, with a high speed mixer such as a HENSCHEL MIXER.

EXAMPLES

The present invention will be described in detail using examples. However, the present invention should not be construed to be limited to the examples. Unless noted otherwise, "parts" and "%" in the explanation of the following examples are based on the weight.

The examples and comparative examples are evaluated by the following tests.

(1) Particle Diameter

Volume average particle diameter (Dv), number average particle diameter (Dp), particle diameter distribution (Dv/Dp), and number ratio of colored polymer particles having particle diameter not larger than 4 μm (namely £ 4 μm, number %), were measured by means of a particle diameter analyzer (trade name: MULTISIZER, product of Beckman-Coulter Inc.). The measurement was conducted under the following conditions:

aperture diameter: 100 μm;

medium: ISOTONE II; and number of particles subjected to measurements: 100,000.

(2) Average Circle Degree 10 mL of water was provided in advance into a vessel container, 0.02 g of a surfactant (alkylbenzen sulfuric acid) was added as a dispersion stabilizer, then 0.02 g of a sample was added into the vessel and dispersed uniformly. To disperse the sample, it was treated with a ultrasonic disperser with power of 60 W for 3 minutes. Circle degree was measured by means of a flow type particle projection image analyzer (trade name: FPIA-1000, product of Sysmex Corporation), while the toner concentration was controlled into the range of 3,000-10,000 particles/μL. The circle degrees are measured for 1,000-10,000 particles having particle diameters not smaller than 1 μm, and the average circle degree were obtained from the values.

(3) Number of Particles of an External Additive Existing on a Single Colored Polymer Particle The toner particles were observed with a scanning electron microscope with amplification of 10,000, and pictures were taken. Number of external additive particles observed on the pictures was counted, and number of particles of a external additive existing on a single colored polymer particle was denoted as a double value counted. Average value was obtained after observation of 10 toner particles.

(4) Charge Amount of the Toner

A commercially available non-magnetic-one-component developing type printer with resolution of 600 dpi (trade name: MICROLINE 3010C, product of Oki Data Corporation) was used. The printer was undisturbed over a day and a night at N/N condition, then 5 sheets were printed at printing density of 5% using a toner to be tested. The toner on the developing roll was vacuumed with a vacuuming-type charge amount measuring apparatus, and charge amount per unit weight was obtained from measured values of charge amount and vacuumed weight.

(5) Cleaning Performance

A toner to be tested and sheets of printing paper were set into the same printer as in the test (4). Continuous printing was achieved at printing density of 5% from the beginning, and number of sheets was counted until cleaning became defective. Here the printing was terminated when number of sheets reached to 2,000.

(6) Dot Copy Reproduction

Printing of 1 by 1 image was achieved using the same printer as in the test (4). The ratio of dots reproduced accurately was obtained by observing 10×10 dots.

(7) Fog.

The same printer as in the test (4) was used. The printer existed undisturbed over a day and a night at N/N condition. After 10 sheets were printed continuously at printing density of 5%, white printing (printing density of 0%) was achieved, then printing was terminated. After the white printing, the toner on the photoconductive member was stripped off and collected by sticking with an adhesive tape (trade name: SOTHCH MENDING TAPE 810-3-18, product of Sumitomo 3M Limited). Then the adhesive tape was peeled to stick it on a new sheet of paper to measure "hue (B)," using a spectrophotometer (trade name: SE2000, product of Nippon Denshoku Industries Co., Ltd.). As a control, an adhesive tape alone was attached on another new sheet of paper to measure "hue (A)." Fog value was calculated and denoted as color difference ΔE* after hue values were expressed as a coordinate in an L*a*b* space. Smaller value of ΔE* means less fog.

Example 1

24 parts of methyl ethyl ketone and 6 parts of methanol was added and dispersed into 100 parts of negative charge control resin (trade name: FCA626N, product of Fujikura Kasei Co., Ltd., constitutional repeating units including sulfonic acid group: 7 weight %), and the resultant mixture was mixed and kneaded with a roll machine with cooling. After the mixture was winded on the rolls, 100 parts of a solid solution pigment (trade name: FUJI FAST CARMIN 528, product of Fuji Colorant, including C.I. pigment red 150 and C.I. pigment red 31) was added gradually as a magenta pigment, the resultant mixture was agitated for a hour, and a negative charge control resin composition was obtained. Here, clearance between the rolls was 1 mm at beginning, broadened gradually, to 3 mm at end, and organic solvent (mixed solvent of methyl ethyl ketone/methanol=4/1) was added occasionally according to mixing condition of the negative charge control resin composition. Added organic solvent was eliminated under reduced pressure after mixing was over.

Separately, an aqueous solution of 6.6 parts of sodium hydroxide (alkali metal hydroxide) dissolved in 50 parts of ion-exchanged water was gradually added to an aqueous solution of 10.8 parts of magnesium chloride (water-soluble polyvalent metallic salt) dissolved in 250 parts of ion-exchanged water, during stirring, to prepare an aqueous dispersion medium containing magnesium hydroxide colloid (colloid of hardly water-soluble metal hydroxide).

A polymerizable monomer mixture for core comprising 89 parts of styrene, 11 parts of n-butyl acrylate, 0.725 part of divinylbenzene and 0.25 part of a polymethacrylic ester macromonomer (trade name: AA6, product of Toagosei Chemical Industry Co., Ltd.); 12 parts of the above-mentioned negative charge control resin composition; and 10 parts of dipentaerythritol hexamyristate; were mixed, agitated and dispersed uniformly, thus a polymerizable monomer composition for core was obtained. Separately, 2 parts of methyl methacrylate and 65 parts of water were subjected to a finely dispersing treatment by an ultrasonic emulsifier to obtain a polymerizable monomer composition for shell. D90 of the particle diameter of droplets of the polymerizable monomer composition for shell was 1.6 μm.

The polymerizable monomer composition for core was poured into the colloidal dispersion medium of magnesium hydroxide (weight of the colloid: 8.4 parts), and the resultant mixture was stirred until droplets became stable. 1 part of triisobutyl mercaptan (product of Bayer A.G.), 1 part of tetraethyl thiuram disulfide (product of Ouchi Shinko Chemical Industrial Co., Ltd.) and six parts of t-butyl peroxy-2-ethylhexanoate (trade name: PERBUTYL O, product of NOF Corporation) were added to the mixture. Then the resultant dispersion was stirred, under high shearing force, at 15,000 rpm, for 30 minutes, by means of an EBARA MILDER (product of Ebara Corporation), to generate finer droplets of the polymerizable monomer composition. Thus obtained aqueous dispersion including the droplets of the polymerizable monomer composition for core was provided into a reactor equipped with an agitating blade. The dispersion was heated up to 90° C. to initiate a polymerization reaction. The reaction was achieved until the conversion ratio into a polymer reached almost 100%. Then the polymerizable monomer composition for shell and a solution of 0.2 parts of 2,2'-azobis{2-methyl-N-(2-hydroxyethyl)propionamide } (trade name: VA-086, product of Wako Pure Chemical Industries, Ltd.) dissolved into 65 parts of distilled water were provided into the reactor. After the polymerization reaction was continued for 8 hours, the reaction was stopped to obtain a dispersion including the core-shell structure colored polymer particle.

Thus obtained dispersion including the core-shell structure colored polymer particle was: washed with acid (at 25° C. for 10 minutes) by controlling pH thereof not larger than 5 with sulfonic acid while stirring; dehydrated by filtration; and washed with water after generating slurry again by adding 500 parts of ion exchanged water. Then, after the solid content was dehydrated and washed by water for several times, it was separated by filtration and dried at 45° C. for 2 days and nights with a drier. Thus obtained colored polymer particle had volume average particle diameter (Dv) of 6.4 μm, particle diameter distribution (Dv/Dp) of 1.21, average circle degree of 0.982, and such particle diameter distribution that number ratio of colored polymer particles having particle diameter not larger than 4 μm was 9.1 number %.

100 parts of thus obtained colored polymer, 1.0 part cube shaped calcium carbonate with volume average particle diameter of 0.3 μm (trade name: CUBE-03BHS, Dv/Dp: 1.26, density: 2.6 g/mL, product of Maruo Calcium Co., Ltd.), 0.5 part of fine silica particle with volume average particle diameter of 12 nm (trade name: RX-200, product of Nippon Aerosil Co., Ltd.) and 2.0 parts of fine silica particle with volume average particle diameter of 40 nm (trade name: RX-50, product of Nippon Aerosil Co., Ltd.) were mixed at 1,400 rpm for 10 minutes with a HENSCHEL MIXER to obtain a toner. The printing properties and other properties of the obtained toner were evaluated. The results are shown in Table 1.

Example 2

A toner was obtained in the same manner as in Example 1 except that 0.5 part of calcium phosphate with volume average particle diameter of 0.5 μm (trade name: HAP05-NP, Dv/Dp: 1.51, density: 2.55 g/mL, spherical shaped, product of Maruo Calcium Co., Ltd.) was used instead of the cube shaped calcium carbonate with volume average particle diameter of 0.3 μm. The toner was evaluated in the same manner as in Example 1. The results are shown in Table 1.

Comparative Example 1

A toner was obtained in the same manner as in Example 1 except that the cube shaped calcium carbonate with volume average particle diameter of 0.3 μm was not used. The toner was evaluated in the same manner as in Example 1. The results are shown in Table 1.

Comparative Example 2

The following materials were mixed and stirred with a Sand Stirrer to obtain a polymerizable composition:

100 parts of styrene;

35 parts of n-butyl methacrylate;

5 parts of methacrylic acid;

0.5 part of 2,2'-azobis(2,4-dimethylvaleronitrile);

3 parts of low molecular weight polypropylene (trade name: Viscol 605P, 5Sanyo Chemical Industries, Ltd.);

8 parts of carbon black (trade name: MA#8, product of Mitsubishi Chemical Corporation); and 3 parts of chromium complex salt dye (trade name: AIZEN SPILON BLACK TRH, product of Hodogaya Chemical Co., Ltd.).

Then the resultant composition was subjected to polymerization reaction at 60° C. for 6 hours, in a aqueous solution of 6 weight/volume % gum arabic, with stirring at 4,000 rpm by means of a mixer (TK AUTO HOMO MIXER, product of Tokushu Kika Kogyo Co., Ltd.). After polymerization reaction, washed with ion exchanged water, dried, classified with wind force (blowing air), then a colored polymer particle with volume average particle diameter of 8 μm were obtained. Number ratio of the colored polymer particles having particle diameter not larger than 4 μm was 1.3 number %. Further the colored polymer particle was subjected to a surface treatment with a dispersion solution of a resin fine particle (a fine particle of fluorinated ethylene propylene copolymer, volume average particle diameter: 2 μm, product of Du Pont—Mitsui Fluorochemicals Co., Ltd.) dispersed sufficiently into a mixture of ethanol/water (volume ratio: 8/2) so that the proportion of the resin fine particle is 2.0 parts by weight per 100 parts by weight of the colored polymer particle. More specifically, the treatment was achieved by immersion method by means of a wet type surface reforming device (trade name: DISPER COAT, product of Nissin Engineering Co., Ltd.) so that the resin fine particle adhered locally on the surface of the colored polymer particle. 100 parts of the thus obtained colored polymer particle and 0.3 part of a hydrophobicitized silica particle (trade name: R-974, volume average particle diameter: 12 nm, density: 2.2 g/mL, spherical shaped, product of Nippon Aerosil Co., Ltd.) were mixed at 1,500 rpm for 1 minute with a HENSCHEL MIXER to obtain a toner with volume average particle diameter of 8 μm. The printing properties and other properties of the obtained toner were evaluated in the same manner as in Example 1. The results are shown in Table 1.

TABLE 1

| | Example 1 | Example 2 | Comparative Example 1 | Comparative Example 2 |
|---|---|---|---|---|
| Properties of toner | | | | |
| Volume average particle diameter (μm) | 6.4 | 6.4 | 6.4 | 8.0 |
| Average circle degree | 0.982 | 0.982 | 0.982 | 0.896 |
| Charge amount (μC/g) | −64 | −42 | −78 | −12 |
| Number of external additive particles | 149 | 16 | 0 | 0 |
| Number ratio of colored polymer particles having particle diameter ≦ 4 μm (number %) | 9.1 | 9.1 | 9.1 | 1.3 |
| Properties of image | | | | |
| Cleaning properties (number of sheets) | ≧20,000 | ≧20,000 | 500 | 3,000 |
| Dot copy reproduction (%) | 93 | 90 | 57 | 68 |
| Fog | 0.46 | 0.72 | 0.58 | 4.6 |

As remarkably shown in Table 1, the toners of Example 1 and 2 have better cleaning performance as well as better printing properties than those of Comparative Examples 1 and 2.

INDUSTRIAL APPLICABILITY

The present invention provides a toner that has excellent cleaning performance and supplies excellent images, when it is used for an image-forming apparatus, which has a cleaning means with a cleaning blade to remove a residual toner remaining on a surface of a photoconductive member after transfer. The present invention also provides an image-forming method using such a toner. The toner and the image-forming method of the present invention are useful for electro photography devices such as printers and copiers.

What is claimed is:

1. A toner for an image-forming apparatus, which has a cleaning means with a cleaning blade to remove a residual toner remaining on a surface of a photoconductive member after transfer;

the toner comprises:

a colored polymer particle and an inorganic particle as the external additive, wherein the colored polymer particle is produced by polymerization reaction and has a core-shell structure, wherein the colored polymer particle has an average circle degree in the range of 0.95-0.995 and a volume average particle diameter in the range of 3-8 μm, and wherein the external additive comprises (A) calcium phosphate particles or calcium carbonate particles having a volume average primary particle diameter in the range of 0.1 to 3.0 μm, (B) small-sized fine silica particles having a volume average primary particle diameter in the range of 5 to 18 nm; and (C) large-sized fine silica particles having a volume average primary particle diameter in the range of 20 to 60 nm, which toner has an absolute value of charge amount measured by aspirating and collecting the toner with an aspirating charge amount analyzer in the range of 20-70 μC/g in a toner layer formed on a developing roll when the toner is used with the image-forming apparatus, and the average number of particles of the external additive, having a particle diameter in the range of 0.1-3.0 μm, on the surface of the colored polymer particle, is in the range of 10-500 particles per single colored polymer particle.

2. The toner according to claim 1, wherein the colored polymer particle further comprises a parting agent.

3. The toner according to claim 1, wherein the colored polymer particle has such a particle diameter distribution that particles with diameter not larger than 4 μm is in the portion of 3-9.1 number percent.

4. The toner according to claim 1, wherein the colored polymer particle further comprises a charge control resin with a weight average molecular weight in the range of 2,000-50,000.

* * * * *